US010612185B2

(12) United States Patent
Javit et al.

(10) Patent No.: US 10,612,185 B2
(45) Date of Patent: Apr. 7, 2020

(54) STEAM DE-WRINKLING APPLIANCE HAVING A DE-WRINKLING HEAD CONNECTED BY A LINE TO A BASE

(71) Applicant: SEB S.A., Ecully (FR)

(72) Inventors: Maxime Javit, Lyons (FR); Guy Ducruet, Charbonnieres les Bains (FR)

(73) Assignee: SEB S.A., Ecully (FR)

( * ) Notice: Subject to any disclaimer, the term of this patent is extended or adjusted under 35 U.S.C. 154(b) by 182 days.

(21) Appl. No.: 15/464,932

(22) Filed: Mar. 21, 2017

(65) Prior Publication Data

US 2017/0275809 A1 Sep. 28, 2017

(30) Foreign Application Priority Data

Mar. 22, 2016 (FR) ..... 16 52447

(51) Int. Cl.

| | |
|---|---|
| ***D06F 73/00*** | (2006.01) |
| ***D06F 75/12*** | (2006.01) |
| ***D06F 87/00*** | (2006.01) |
| ***D06C 7/00*** | (2006.01) |

(52) U.S. Cl.

CPC ..... *D06F 73/00* (2013.01); *D06C 7/00* (2013.01); *D06F 75/12* (2013.01); *D06F 87/00* (2013.01)

(58) Field of Classification Search

None

See application file for complete search history.

(56) References Cited

U.S. PATENT DOCUMENTS 2,241,945 A * 5/1941 Cissell ..... D06F 75/10 38/77.6

8,347,531 B2 1/2013 Krebs et al.

FOREIGN PATENT DOCUMENTS

| | | |
|---|---|---|
| EP | 2746460 A2 | 6/2014 |
| FR | 1560114 | 3/1969 |
| FR | 2912429 A1 | 8/2008 |
| FR | 2971796 A1 | 8/2012 |
| GB | 1215764 | 12/1970 |
| WO | 2005/068706 A2 | 7/2005 |

OTHER PUBLICATIONS

Chelle, Jacky, FR 2971796 Espacenet translation, Domestic iron, has ironing plate, inlet channel that is integrated into sole, outlet formed in cover resulting in network of vapor diffusion in direction of one of groups of steam outlet holes, and joint reducing or blocking vapor supply, 2012 (Year: 2012).*

* cited by examiner

*Primary Examiner* — Jason Y Ko
*Assistant Examiner* — Cristi J Tate-Sims
(74) *Attorney, Agent, or Firm* — The Webb Law Firm

(57) ABSTRACT

A steam de-wrinkling appliance includes a de-wrinkling head connected by a line to a base for producing a steam flow. The de-wrinkling head has a rear portion forming a handle and a flared front portion having a surface with one or a plurality of steam exit holes for distributing the steam flow originating from the base. The de-wrinkling head further includes a device having a movable member capable of assuming a retracted position and a restriction position. The flared front portion encloses a single steam plenum chamber that supplies steam to the steam exit hole or holes.

14 Claims, 8 Drawing Sheets

STEAM DE-WRINKLING APPLIANCE HAVING A DE-WRINKLING HEAD CONNECTED BY A LINE TO A BASE

CROSS-REFERENCE TO RELATED APPLICATION

This application claims priority to French Patent Application No. 1652447 filed Mar. 22, 2016, the disclosure of which is hereby incorporated in its entirety by reference.

BACKGROUND OF THE INVENTION

Field of the Invention

This invention relates to a steam de-wrinkling appliance comprising a de-wrinkling head connected by a line to a base for producing a steam flow, wherein the de-wrinkling head comprises a rear portion forming a handle and a flared front portion comprising a surface equipped with one or a plurality of steam exit holes through which the steam flow originating from the base can be distributed. The invention more particularly relates to an appliance comprising a device for reducing the area of the flow toward the steam exit hole or holes, said flow area-reducing device comprising a movable member that can assume a retracted position, in which the area of the flow toward the steam exit hole or holes is maximal, and a restriction position, in which the movable member reduces the area of the flow toward the steam exit hole or holes.

Description of Related Art

The patent application filed under the number FR 1560114 by the applicant discloses a steam de-wrinkling appliance having a base for producing a steam flow, which base is connected by a line to a de-wrinkling head comprising a rear portion forming a handle and a flared front portion comprising a surface equipped with a plurality of steam exit holes, through which the steam flow originating from the base is distributed. In this document, the de-wrinkling head comprises a device for blocking or reducing the steam flow toward a portion of the steam exit holes, making it possible to concentrate the steam flow toward the other steam exit holes of the sole.

Such a de-wrinkling appliance has the advantage of making it possible to treat thin, steam-permeable textiles effectively by selecting a distribution via all of the steam exit holes of the sole, and to treat areas that are more difficult to de-wrinkle with a more precise treatment by selecting a distribution of steam via a limited number of steam exit holes.

An object of this invention is to propose a de-wrinkling appliance which allows the user to choose between a diffuse steam emission through the sole and a concentrated distribution, but which has a different design than the one described in the prior art.

SUMMARY OF THE INVENTION

To this end, the invention has as an object a steam de-wrinkling appliance comprising a de-wrinkling head connected by a line to a base for producing a steam flow, the de-wrinkling head comprising a rear portion forming a handle and a flared front portion comprising a surface having one or a plurality of steam exit holes for distributing the steam flow originating from the base, characterized in that the flared front portion encloses a single steam plenum chamber that supplies steam to the steam exit hole or holes and further characterized in that the de-wrinkling head comprises a device for reducing the area of the flow toward the steam exit hole or holes, the flow area-reducing device comprising a movable member capable of assuming a retracted position, in which the area of the flow toward the steam exit hole or holes is maximal, and a restriction position, in which the movable member reduces the area of the flow toward the steam exit hole or holes.

Such a steam de-wrinkling appliance has the advantage of being simple and economical to embody and of possessing a de-wrinkling head with very good ergonomics and very good ironing performance.

According to another feature of the invention, the surface has at least a first group of steam exit holes and a second group of steam exit holes, the movable member capable of assuming a retracted position, in which the plenum chamber communicates freely with the entirety of the first and second groups of steam exit holes, and a restriction position, in which the movable member covers, at least partially, the second group of steam exit holes or isolates the steam plenum chamber in order to reduce, even stop, the distribution of steam through the second group of steam exit holes.

According to another feature of the invention, the movable member can be actuated from the outside of the de-wrinkling head by means of a control element, the actuation of the control element making it possible to shift the movable member from the retracted position into the restriction position.

Such a feature enables further improvement of the ergonomics.

According to another feature of the invention, the movable member moves in translation in order to shift from the retracted position into the restriction position.

According to another feature of the invention, the movable member moves in translation in a direction that is essentially perpendicular to the axis of the steam exit holes.

According to another feature of the invention, the control element is connected to the movable member by a rotatably mobile lever.

Such a construction makes it possible to obtain a reversal of the movement direction of the movable member with respect to the movement direction of the control element for greater compactness and better ergonomics of the de-wrinkling head.

According to another feature of the invention, the movable member moves in translation in a direction essentially parallel to the axis of the steam exit holes.

According to another feature of the invention, the control element is connected to the movable member by a part that is movable in translation.

According to another feature of the invention, the flow-blocking or flow-reducing device comprises a spring that tends to return the movable member to the retracted position.

Such a feature makes it possible to obtain an automatic movement of the movable member back into the retraction position such that the flow is automatically distributed via all of the steam exit holes when the control element is not actuated manually by the user.

According to another feature of the invention, the movable member is disposed in the steam plenum chamber.

Such a feature makes it possible to obtain greater compactness of the de-wrinkling head.

According to another feature of the invention, the movable member comprises at least one partition that isolates the plenum chamber when the member assumes the restriction position.

According to another feature of the invention, the movable member comprises two partitions connected to one another by a crosspiece, the steam emitted from the line entering the space formed between the two partitions.

According to another feature of the invention, the movable member covers the holes of the second group of steam exit holes when it assumes the restriction position.

According to another feature of the invention, the movable member comprises pins that engage in the holes of the second group of steam exit holes when it assumes the restriction position.

Such pins have the advantage of ensuring that the movable member is guided axially in relation to the steam exit holes and of reducing the flow area for the steam.

According to another feature of the invention, the line has an end connected to the base, which communicates freely with a boiling chamber, and an end connected to the de-wrinkling head, which communicates freely with the plenum chamber.

Such a feature makes it possible to obtain an appliance with a simple construction that does not use any means of controlling the emission of steam between the base and the de-wrinkling head.

According to another feature of the invention, the surface receiving the steam exit holes is flat and comprises a generally triangular contour.

Such a shape has the advantage of achieving good ergonomics for use and good de-wrinkling performances.

According to another feature of the invention, the steam exit holes are distributed in a V on the surface of the de-wrinkling head, the steam exit holes of the first group being disposed at the pointed end of the V.

According to still another feature of the invention, the total number of steam exit holes is greater than or equal to five holes.

Such a feature makes it possible to obtain a steam distribution via a number of steam exit holes that is sufficient for ensuring the distribution of steam over a large surface, in order to treat textiles that are sufficiently permeable to steam rapidly.

According to another feature of the invention, the first group of steam exit holes comprises less than five steam exit holes and preferably three steam exit holes.

Such a feature makes it possible to concentrate the steam on just some holes for a more precise steam flow.

According to another feature of the invention, the handle comprises a longitudinal end where the line engages in the de-wrinkling head, and an opposite end where the handle extends to form the flared front portion.

Such a feature makes it possible to achieve good maneuverability and good ergonomics for the de-wrinkling head.

According to another feature of the invention, the steam exit hole or holes open directly into the plenum chamber.

BRIEF DESCRIPTION OF THE DRAWINGS

The objects, aspects, and advantages of this invention will be more clearly understood by studying the following description of several special embodiments of the invention that are given as non-limiting examples, and by referring to the appended drawings, wherein.

Only the elements needed for understanding the invention have been illustrated. To make the drawings easier to interpret, the same elements have the same reference signs from figure to figure.

DETAILED DESCRIPTION OF THE INVENTION

Figure 1A:
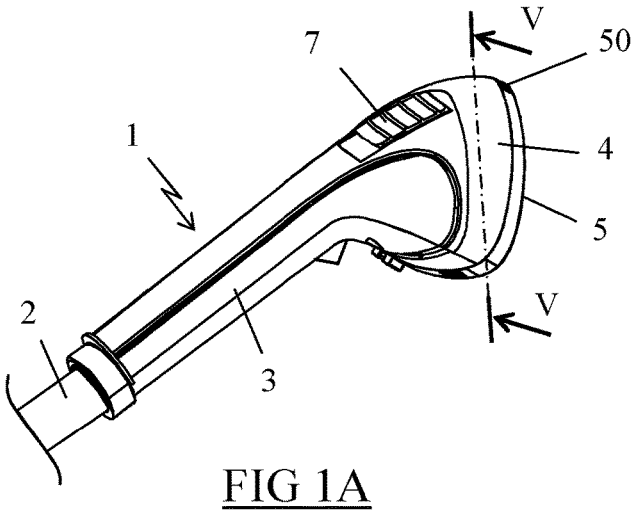
FIGS. 1A and 1B are perspective views of a de-wrinkling head according to a first embodiment of the invention, which is shown with the switch in a first position in which the steam is distributed via all of the holes of the sole and in a second position in which the steam is distributed via a limited number of steam exit holes, respectively.

FIGS. 1A-5B show a de-wrinkling head 1 according to a first embodiment.

The de-wrinkling head 1 is connected by a flexible line 2 to a base, which is not illustrated in the figures and is similar to the one described in more detail in Patent Application FR 2 912 429, said base having, in a manner known per se, a water tank and a boiling chamber, which boiling chamber is equipped with a steam exit orifice connected directly to the de-wrinkling head by the line 2.

The de-wrinkling head 1 comprises a body having a cylindrical rear portion forming a handle 3 and a flared front portion 4 formed in the longitudinal extension of the handle 3. The flared front portion 4 has a flat surface 5 with an overall triangular contour, with curved sides and a front tip 50 formed in the longitudinal extension of the handle 3, the flat surface 5 making a ca. 25° angle with the longitudinal direction of the handle 3.

Figure 2:
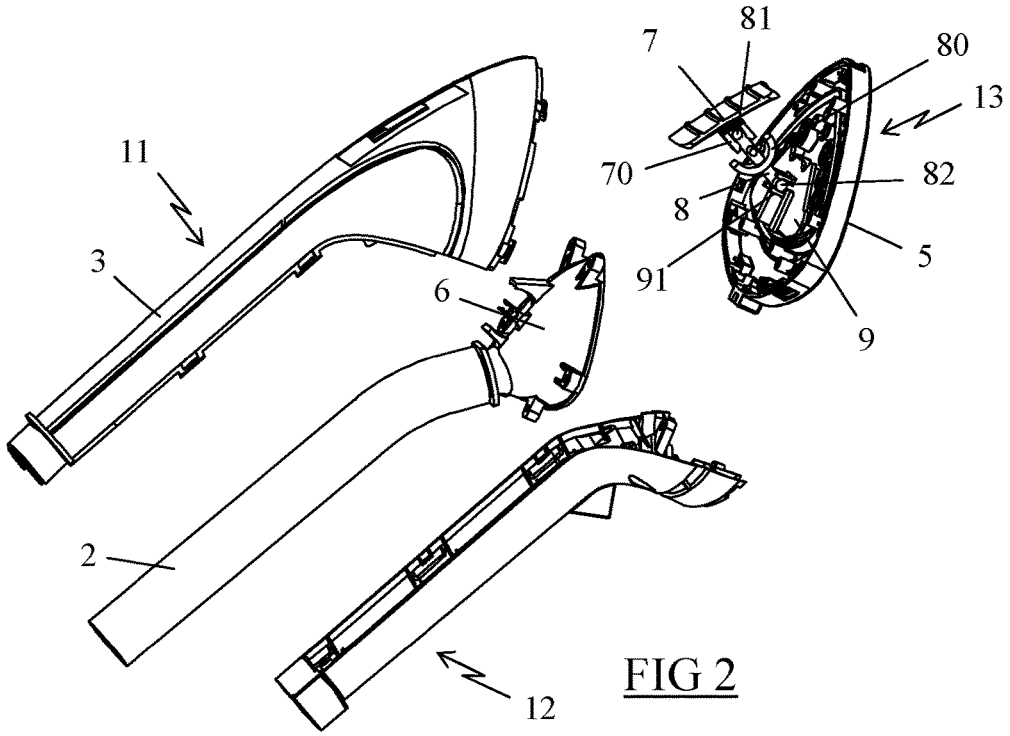
FIG. 2 is an exploded perspective view of the de-wrinkling head of FIG. 1.

Preference is given to the handle 3 and the flared front portion 4 of the de-wrinkling head 1 being assembled from two half-shells 11, 12, which are made of plastic and visible in FIG. 2, and to the flat surface 5 being borne by a sole 13, which is likewise made of plastic and is snapped onto the half-shells 11, 12.

Figure 3A:
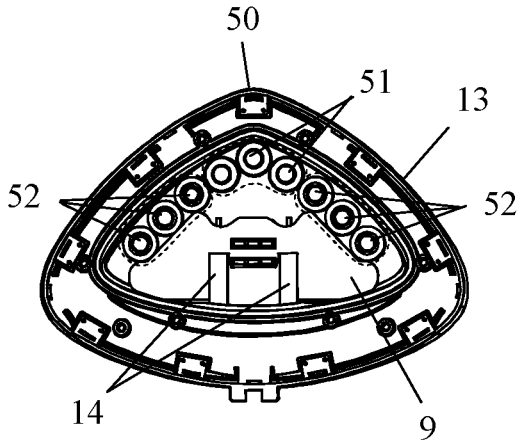
FIGS. 3A and 3B are top views of the sole of the de-wrinkling head of FIG. 1A, with the cover shown in the retracted position and in the restriction position of FIG. 1, respectively.

According to FIG. 3A, the flat surface 5 is equipped with a first group of steam exit holes 51 (surrounded by dashes) comprising three holes distributed in a V near the front tip 50 of the surface 5, and with a second group of steam exit holes 52 having two times three holes disposed in the extension of the holes disposed in a V of the first group of steam exit holes 51.

Figure 4A:
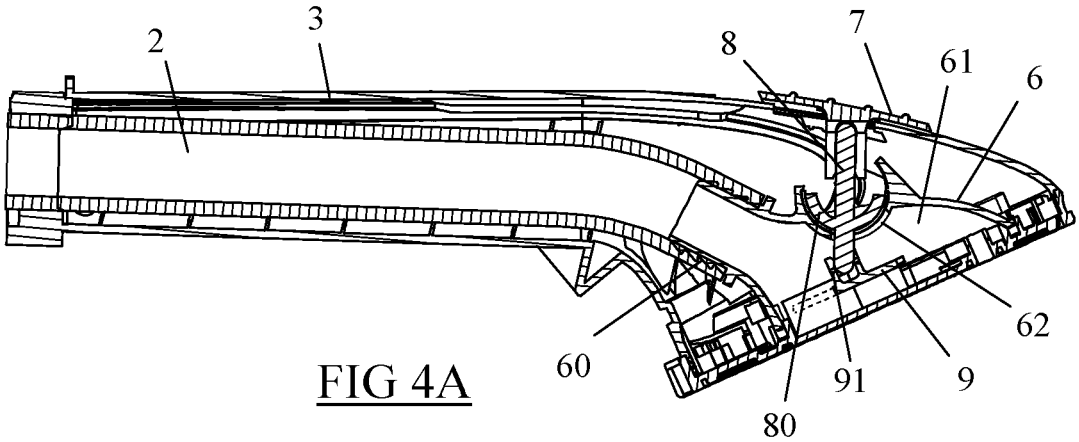
FIGS. 4A and 4B are longitudinal sectional views of the de-wrinkling head of FIG. 1A when the steam concentration switch is in the first position and in the second position, respectively.

According to FIG. 4A, the line 2 engages in the de-wrinkling head 1 via the rear end of the handle 3 and extends longitudinally inside the handle 3 to a coupling 60 borne by a manifold 6 having a single plenum chamber 61 supplying the entirety of the first and second groups of steam exit holes 51, 52. The manifold 6 is advantageously assembled from a plastic part mounted on and sealingly connected to the back face of the sole 13, the coupling 60 establishing fluidic communication between the line 2 and the plenum chamber 61.

More particularly according to the invention, the de-wrinkling head 1 comprises a controllable device for reducing the flow area provided by the steam exit holes 51, 52 of the sole 13.

In this first embodiment, the device comprises a switch 7 making it possible to reduce, even block, the steam flow transmitted toward the second group of steam exit holes 52 in such a way that a greater portion of the steam flow produced by the base, even the entirety of said steam flow, is sent through the first group of steam exit holes 51.

The switch 7 is advantageously disposed near the front end of the handle 3 and is mounted for translatory movement on the body of the de-wrinkling head 1.

According to the first embodiment of the invention, the switch 7 is connected by a lever 8 to a cover 9 mounted for translatory movement on the sole such that the translatory movement of the switch 7 along the de-wrinkling head induces the translatory movement of the cover 9 along the sole 13 in an essentially opposite direction.

Figure 3B:
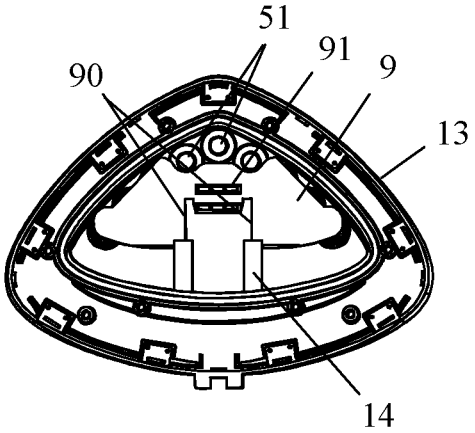

According to FIGS. 2 and 3B, the cover 9 is guided in translation on the sole 13 by means of two guide tracks 14, which are borne by the inside face of the sole 13 and in which two longitudinal edges 90 of the cover 9 bordering a rectangular notch formed on the rear portion of said cover 9 engage.

In the special exemplary embodiment illustrated in the figures, the lever 8 is rotatably mounted on the manifold 6 by means of a circular sector 80 disposed essentially at mid-height on the lever 8, which pivots in a circular recess 62 formed on the upper face of the manifold 6, said circular recess 62 having a slot allowing the passage of the lower portion of the lever 8, which is visible in FIG. 4A.

As can be seen in FIG. 2, the lever 8 comprises an upper end having a transversal finger 81 that engages between two arms 70 borne by the switch 7 so as to form a sliding pivot linkage between the switch 7 and the upper end of the lever 8, and further comprises a lower end equipped with a transversal finger 82 that snaps into a circular recess formed between two arms 91 born by the cover 9 so as to form a simple pivot linkage.

Figure 5A:
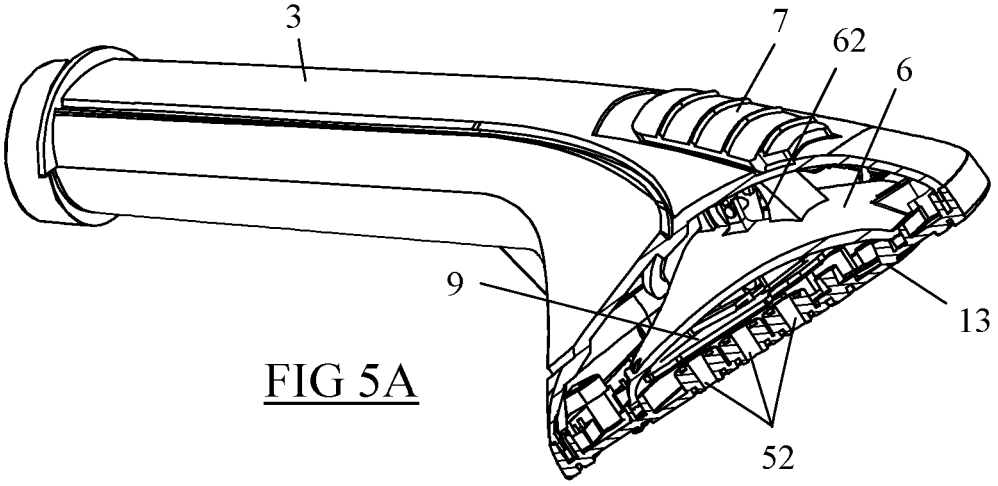
FIGS. 5A and 5B are sectional views along the line V-V of FIG. 1A, with the steam concentration switch in the first position and in the second position, respectively.

The mechanism thus embodied enables the switch 7 to assume a first position illustrated in FIGS. 1A, 4A and 5A, in which the switch 7 is moved toward the sole 13 and the cover 9 is in a retracted position, which is illustrated in FIG. 3A. In this retracted position, the cover 9 is offset axially from the second group of steam exit holes 52 in such a way that the steam flow prevailing in the plenum chamber 61 can pass freely through all of the holes belonging to the first and second groups of steam exit holes 51, 52.

Figure 1B:
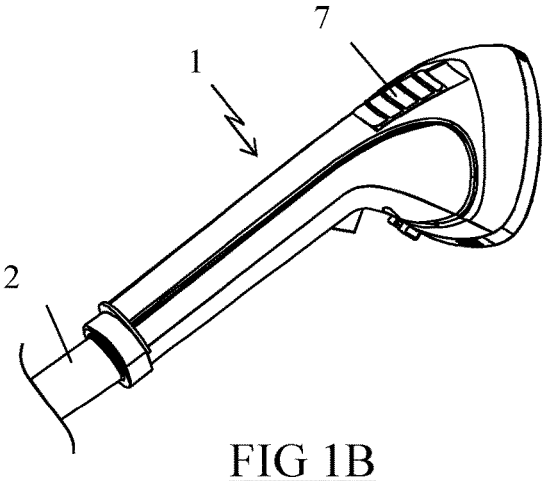
Figure 4B:
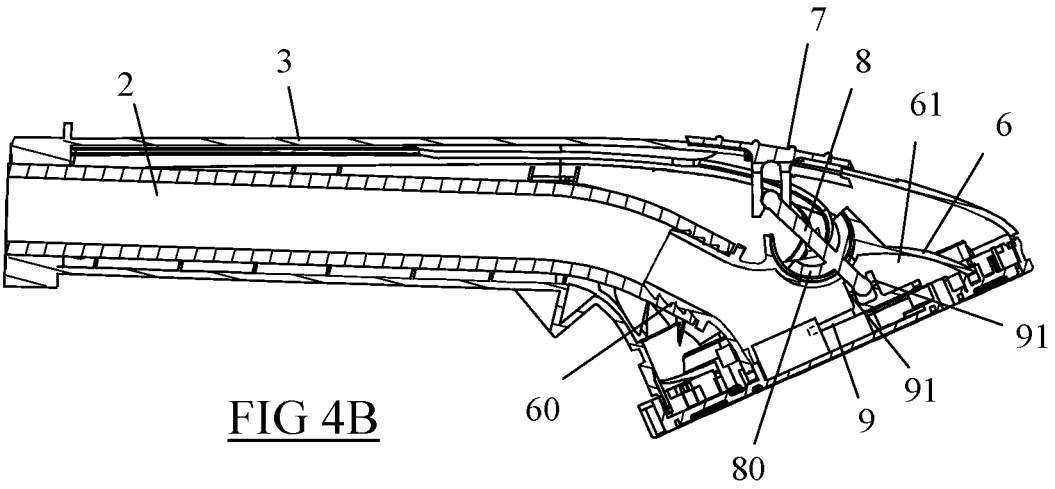
Figure 5B:
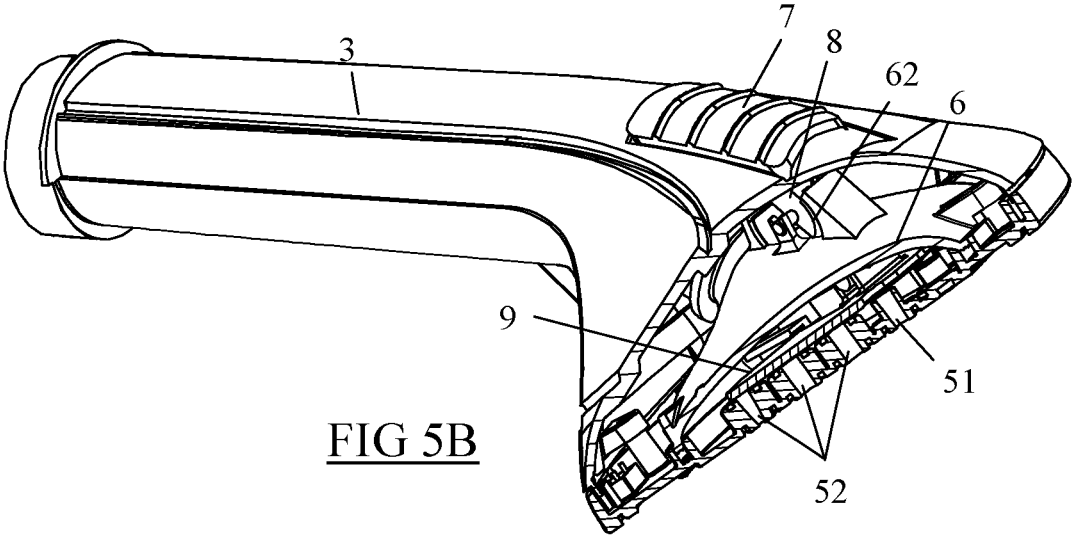
Figure 6:
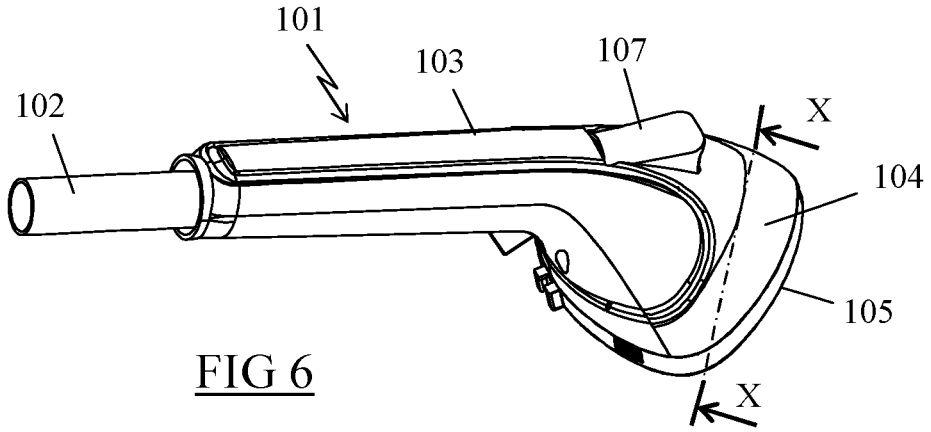
FIG. 6 is a perspective view of a de-wrinkling head according to a second embodiment of the invention.

The switch 7 can also assume a second position, namely a steam concentration position shown in FIGS. 1B, 4B and 5B, in which the switch 7 is moved back toward the handle 3 and the cover 9 then assumes a position illustrated in FIG. 3B, in which it restricts the overall flow area provided by the steam exit holes 51, 52 of the sole 13. In this restriction position, the cover 9 covers the second group 52 of steam exit holes, blocking the access to the latter in such a way that the steam flow prevailing in the plenum chamber 61 cannot pass through the steam exit holes belonging to the second group of steam exit holes 52.

When the switch 7 is in the second position, the de-wrinkling head 1 thus embodied therefore makes it possible to concentrate the steam flow on the first group of steam exit holes 51, i.e. on the holes disposed near the front tip 50 of the surface 5.

Concentrating the steam flow on a limited number of holes in this manner has the advantage of making it possible to obtain a powerful and precise steam flow for more effectively targeting a particular area to de-wrinkle.

Figure 3C:
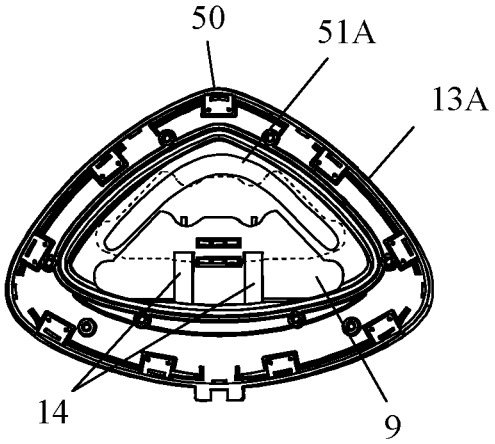
FIG. 3C shows a variant of embodiment of the sole equipping the de-wrinkling head of FIG. 1.

FIG. 3C illustrates a sole 13A corresponding to a variant of embodiment of the sole 13 capable of equipping the de-wrinkling head of FIGS. 1-5B.

In this variant of embodiment, the sole 13A comprises a single steam exit hole 51A in lieu of the first and second groups of steam exit holes. According to this figure, the steam exit hole 51A advantageously has the form of a V-shaped slot that extends over the area of the sole initially having the two groups of steam exit holes.

The functioning of the de-wrinkling head 1 equipped with the sole 13A thus embodied is otherwise similar to that described above.

Indeed, when the cover 9 is in the retracted position (illustrated with a solid outline in FIG. 3C), it is offset axially from the steam exit hole 51A in such a way that the steam flow prevailing in the plenum chamber 61 can pass freely through the entire passage area provided by the steam exit hole 51A.

When the cover 9 is in the flow area restriction position (illustrated with dashes in FIG. 3C), it covers two thirds of the steam exit hole 51A, specifically the two end zones of the steam exit hole 51A, in such a way that the steam flow prevailing in the plenum chamber 61 can only pass through the central portion of the steam exit hole 51A.

Concentrating the steam flow on a limited zone of the steam exit hole 51A in this manner has the advantage of making it possible to obtain a powerful and precise steam flow for more effectively targeting a particular area to de-wrinkle.

FIGS. 6-10B illustrate a de-wrinkling head 101 according to a second embodiment, the de-wrinkling head 101 being connected by a flexible line 102 to a base for generating steam analogous to the one described for the first embodiment.

In this second embodiment, the de-wrinkling head 101 comprises a body having a cylindrical rear portion forming a handle 103 in which the line 102 engages, and further comprises a flared front portion 104 formed in the longitudinal extension of the handle 103.

Figure 7:
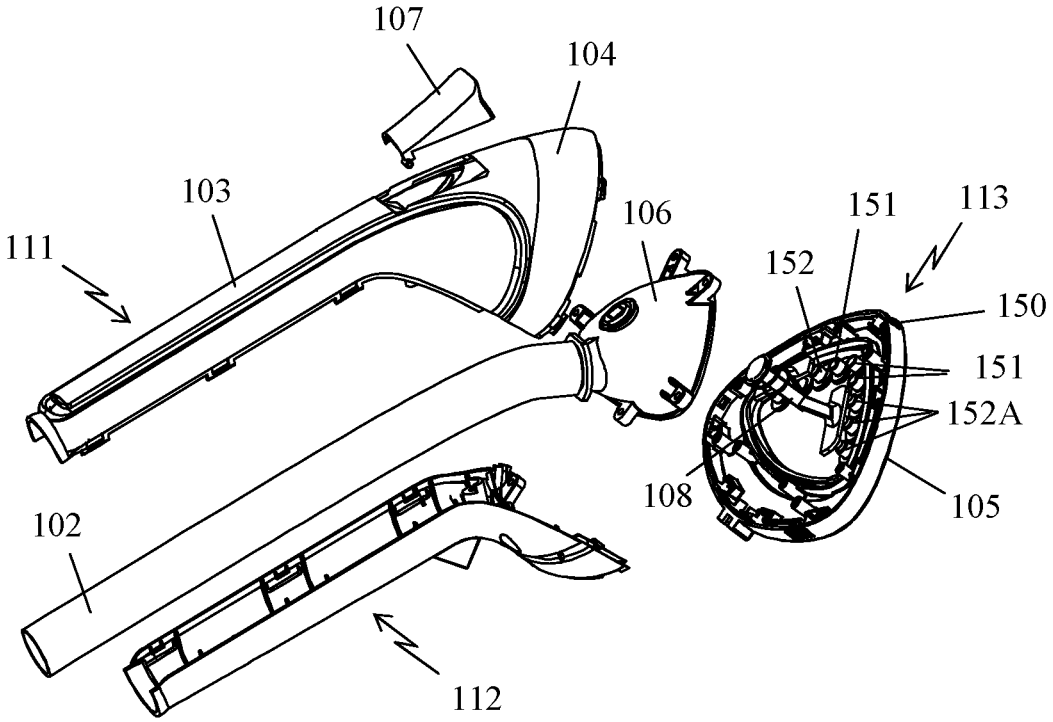
FIG. 7 is an exploded perspective view of the de-wrinkling head of FIG. 6.

According to FIG. 7, the handle 103 and the flared front portion 104 of the de-wrinkling head 101 are assembled from two half-shells 111, 112 made of plastic, onto which a sole 113 likewise made of plastic is snapped, wherein said sole 113 has a generally triangular contour with curved sides and a front tip 150 formed in the longitudinal extension of the handle 103.

In a manner similar to the first embodiment, the sole 113 comprises a flat surface 105 equipped with a first group of steam exit holes 151 having three holes distributed in a V near the front tip 150 of the surface 105 and with a second group of steam exit holes 152 comprising two times three holes disposed in the extension of the holes disposed in a V of the first group 151 of steam exit holes.

Figure 9A:
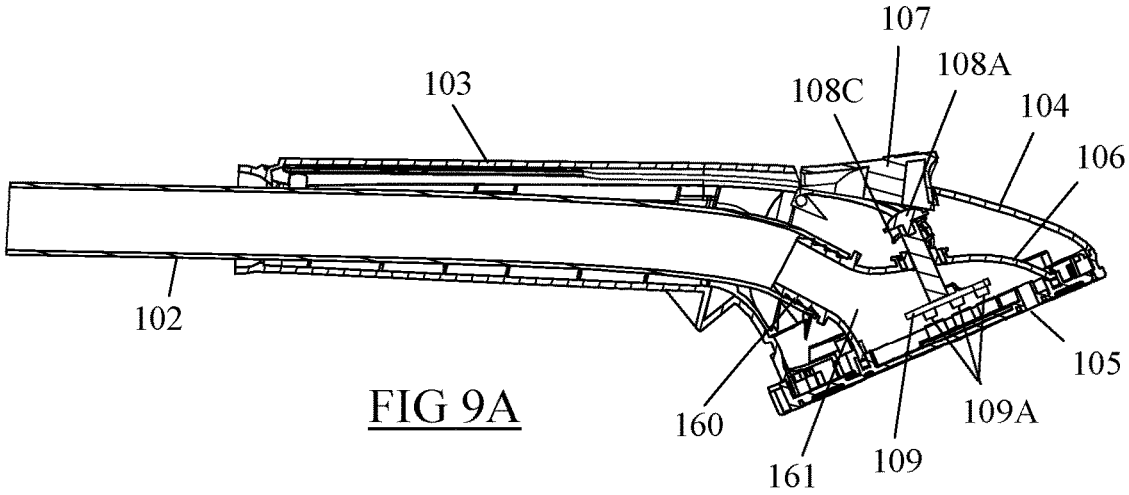
FIGS. 9A and 9B are longitudinal sectional views of the de-wrinkling head of FIG. 6, with the steam concentration switch in a resting position and in a pressed-in position, respectively.

According to FIGS. 7 and 9A, the line 102 extends longitudinally inside the handle 103 to a coupling 160 borne by a manifold 106 having a single plenum chamber 161 supplying the entirety of the first and second groups of steam exit holes 151, 152. The manifold 106 is assembled from a plastic part mounted on and sealingly connected to the back face of the sole 113, said coupling establishing the communication between the line 102 and the plenum chamber 161.

The de-wrinkling head 1 comprises a switch 107 disposed near the front end of the handle 103 that makes it possible to reduce, even block, the steam flow transmitted toward the second group of steam exit holes 152 in such a way that a greater portion of the steam flow produced by the base, even the entirety of this steam flow, is sent through the first group of steam exit holes 151.

More particularly according to this second embodiment, the switch 107 is pivot-mounted on the body of the de-wrinkling head 101 and comprises a lower face abutting with a push-piece 108A disposed at the end of a rod 108 mounted on the manifold 106 for translatory movement in a direction perpendicular to the plane of the surface 105.

Figure 8:
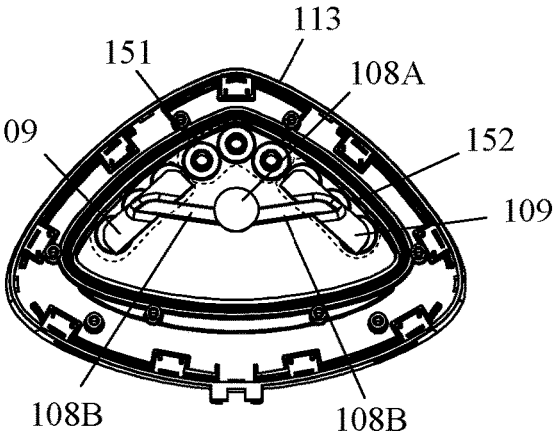
FIG. 8 is a top view of the sole of the de-wrinkling head of FIG. 6.

The lower end of the rod 108 comprises two transversal arms 108B, which are visible in FIG. 8 and which each support a cover 109 for the second group of steam exit holes 152, each cover 109 advantageously having three pins 109A designed to engage in tubes 152A disposed upstream of the holes of the second group of steam exit holes 152 for plugging the latter when the cover 109 is applied against the sole 113.

Figure 10A:
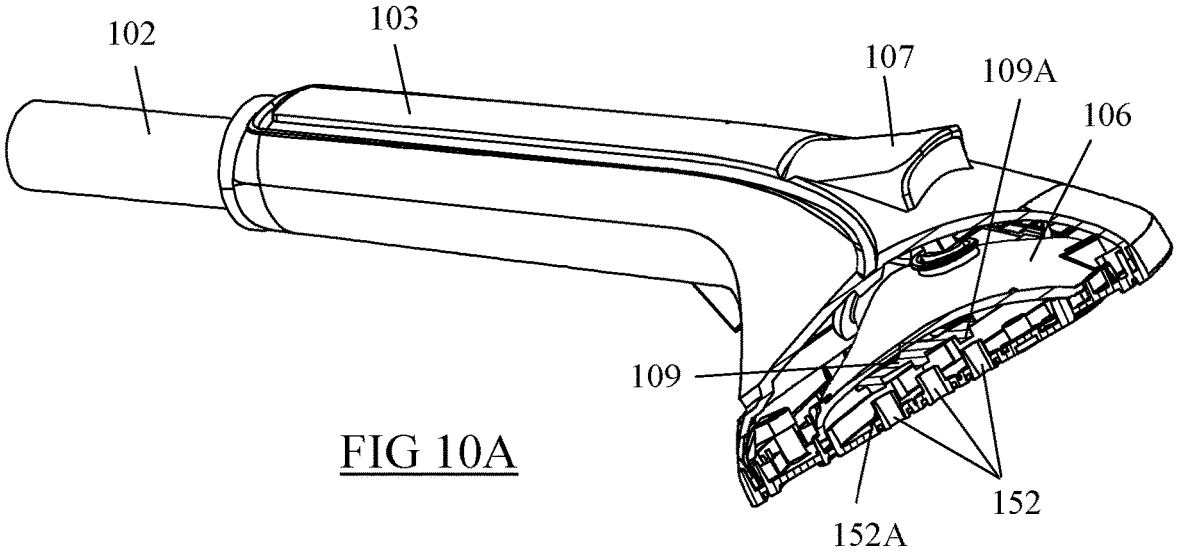
FIGS. 10A and 10B are sectional views along the line X-X of FIG. 6, with the steam concentration switch in the resting position and in the pressed-in position, respectively.

According to FIGS. 9A and 10A, the switch 107 is automatically returned to a first, or resting, position by a return spring 108C, which pushes the rod 108 toward the switch 107, the cover 109 then assuming a retracted position in which the pins 109A are out of the tubes 152A surrounding the holes of the second group of steam exit holes 152 so that the steam can flow freely through the latter.

Figure 9B:
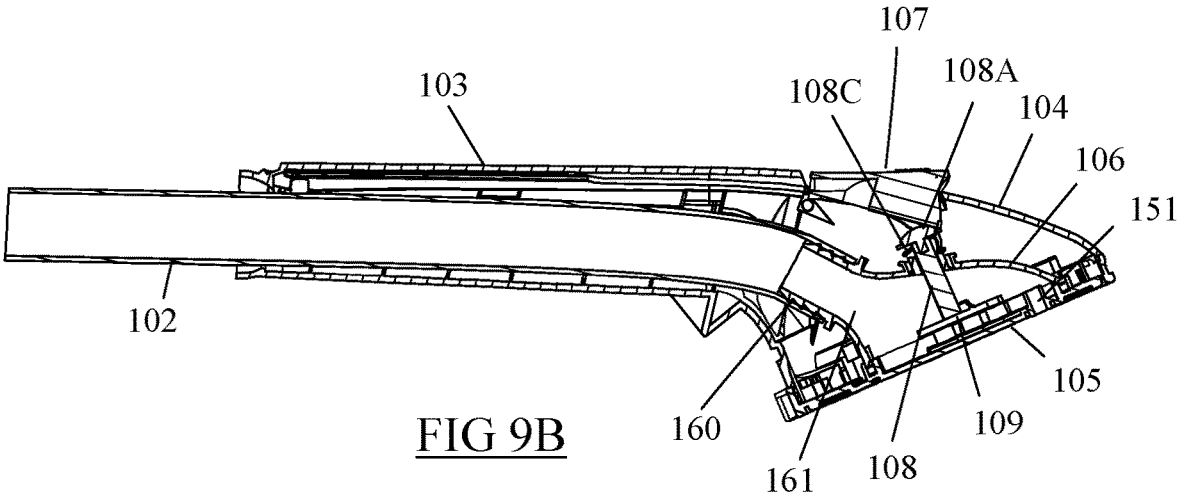
Figure 10B:
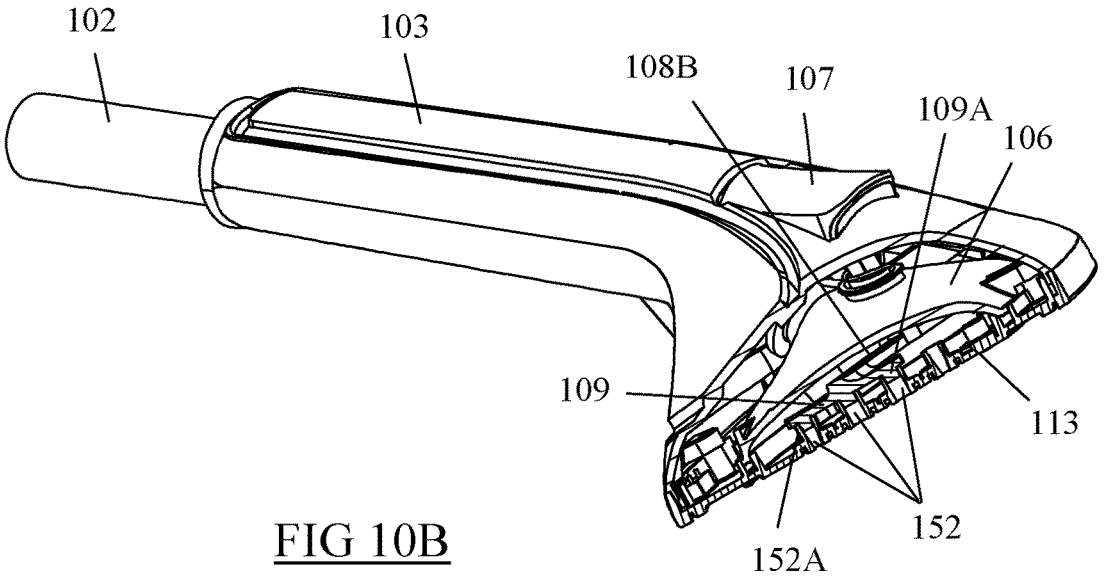
Figure 11:
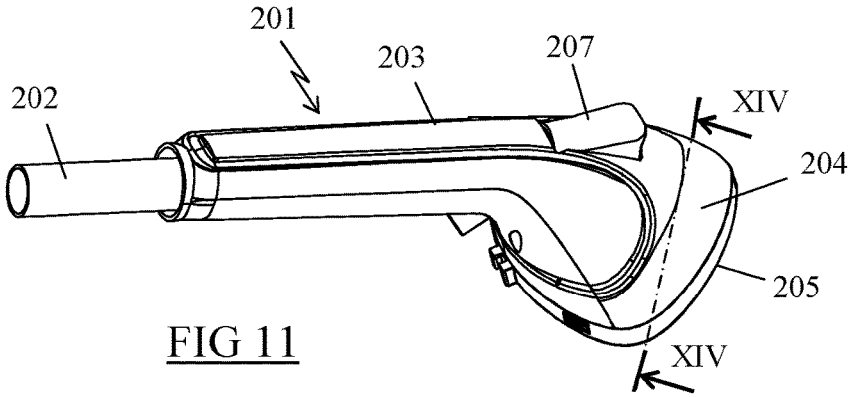
FIG. 11 is a perspective view of a de-wrinkling head according to a third embodiment of the invention.

The switch 107 can also be moved by pressing it manually into a second, so-called steam concentration position illustrated in FIGS. 9B and 10B, in which the rod 108 is pushed by the switch 107 toward the sole 113, compressing the return spring 108A such that the cover 109 assumes a position in which the overall flow area provided by the steam exit holes 151, 152 of the sole 113 is restricted. In this restriction position, the cover 109 comes to rest on the edges of the tubes 152A, with the pins 109A inserted therein, which inhibits or greatly reduces the flow of steam through the second group of steam exit holes 152.

Exactly as in the first embodiment, the de-wrinkling head 101 thus embodied makes it possible to obtain a steam flow that can be distributed over the entirety of the first and second groups of steam exit holes 151, 152 when the switch 107 is in the resting position, or concentrated only on the first group of steam exit holes 151, in other words on the holes disposed near the front tip 150 of the surface 105 when the user moves the switch 107 into the second position by pressing it.

Exactly as in the first embodiment, in a variant of embodiment not illustrated here, the de-wrinkling head could obviously likewise comprise a sole equipped with a single steam exit hole in the shape of an elongate slot, a portion of which would be covered by the cover when the user moves the switch into the second position by pressing it.

FIGS. 11-14B illustrate a de-wrinkling head 201 according to a third embodiment, said de-wrinkling head 201 being connected by a flexible line 202 to a base for generating steam like the one described for the first embodiment.

Similarly to the first and second embodiments, the de-wrinkling head 201 comprises a body having a cylindrical rear portion forming a handle 203 in which the line 202 is engaged, and a flared front portion 204 formed in the longitudinal extension of the handle 203.

Figure 12:
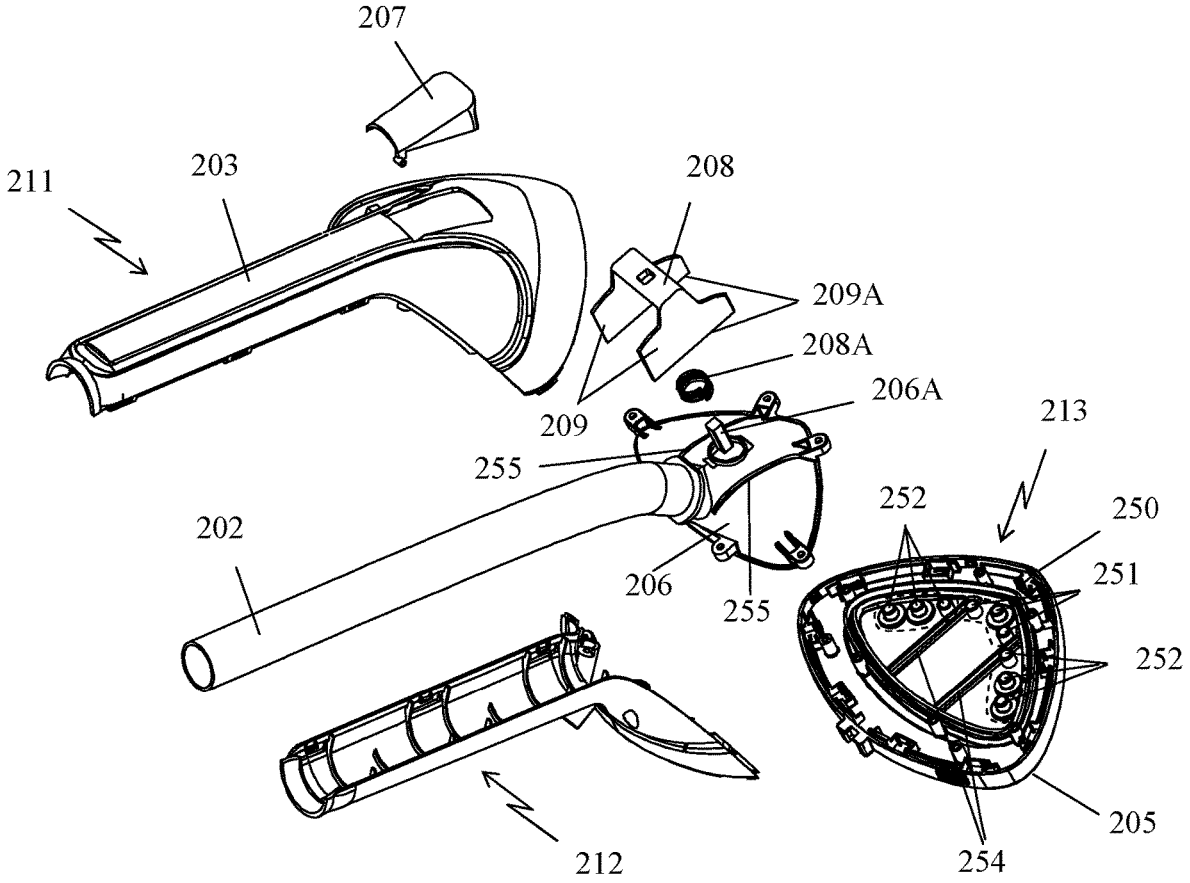
FIG. 12 is an exploded perspective view of the de-wrinkling head of FIG. 11.

According to FIG. 12, the handle 203 and the flared front portion 204 of the de-wrinkling head are assembled from two plastic half-shells 211, 212, onto which is snapped a sole 213, said sole likewise being made of plastic, having a generally triangular contour, with curved sides, and a front tip 250 formed in the longitudinal extension of the handle 203.

Similarly to the first embodiment, the sole 213 comprises a surface 205 advantageously equipped with a first group of steam exit holes 251 having three holes distributed in a V near the front tip 250 of the surface 205, and with a second group of steam exit holes 252 having two times three holes disposed in the extension of the holes disposed in a V of the first group of steam exit holes 251.

Figure 13:
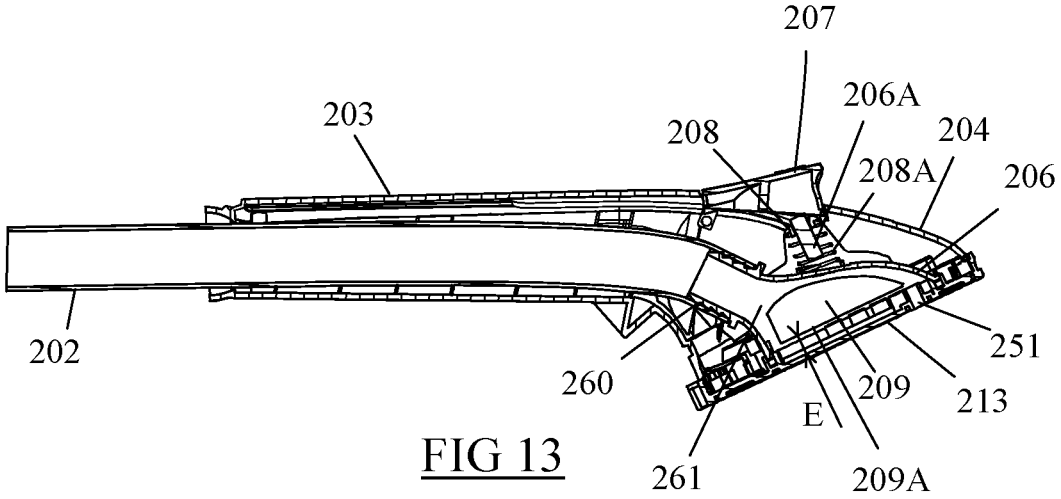
FIG. 13 is a longitudinal sectional view of the de-wrinkling head of FIG. 11, with the steam concentration switch in the resting position.

According to FIG. 13, the line 202 extends longitudinally inside the handle 203 to a coupler 260 borne by a manifold 106 having a single plenum chamber 261 supplying the entirety of the first and second groups of steam exit holes 251, 252. The manifold 206 is assembled from a plastic part mounted on and sealingly connected to the back face of the sole 213, the coupler 260 establishing fluidic communication between the line 202 and the plenum chamber 261.

The de-wrinkling head 201 comprises a switch 207 that is pivot mounted on the body of the de-wrinkling head 201 near the front end of the handle 203, the switch 207 making it possible to reduce, even block, the steam flow transmitted toward the second group of steam exit holes 252 in such a way that a greater portion of the steam flow produced by the base, even the entirety of this steam flow, is sent through the first group of steam exit holes 251.

More particularly according to the third embodiment of the invention, the switch 207 comprises a lower face abutting with a crosspiece 208 linking two partitions 209, the crosspiece 208 being mounted, for translatory movement in a direction perpendicular to the plane of the surface 205, on a rod 206A with a square cross section borne by the manifold 206.

According to FIG. 12, the two partitions 209 are movable in translation in parallel slots 255 formed on the manifold 206 on both sides of the coupler 260, the two partitions 209 extending inside the plenum chamber 261 and forming a space between themselves, into which the steam exiting from the line 202 enters.

The two partitions 209 have a flat lower end 209A facing grooves 254 formed on the sole 213, the holes of the first group of steam exit holes 251 being disposed in the space formed between the two grooves 254 and the holes of the second group of steam exit holes 252 being disposed outside this space.

Figure 14A:
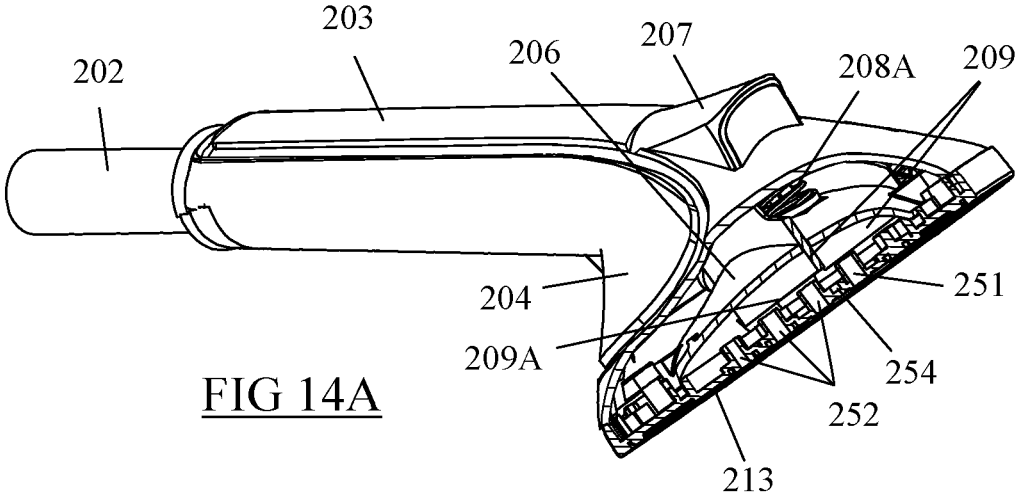
FIGS. 14A and 14B are sectional views along the line XIV-XIV of FIG. 11, with the steam concentration switch in the resting position and in the pressed-in position, respectively.

According to FIGS. 13 and 14A, the crosspiece 208 and thus the switch 207 are automatically returned to a first (resting) position by a return spring 208A that pushes the crosspiece 208 toward the switch 207, the partitions 209 thus assuming a retracted position in which their lower end 209A is retracted from the grooves 254 such that a space E (identified in FIG. 13) in which the steam can flow freely arises between the bottom of the grooves 254 and the lower end 209A of the partitions 209.

Figure 14B:
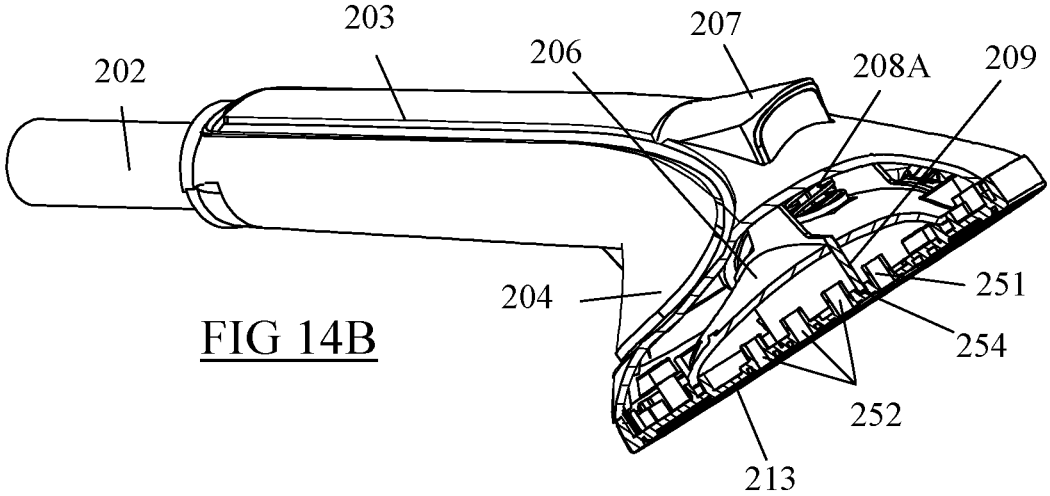

By pressing it by hand, the switch 207 can also be moved into a second, or steam concentration, position shown in FIG. 14B, in which the crosspiece 208 is pushed by the switch 207 toward the sole 213, compressing the return spring 208A such that the partitions 209 assume a position for restricting the flow area, in which the lower end of the partitions 209 rests in the bottom of the grooves 254, thus preventing the steam from flowing under the partitions 209 and thus toward the holes of the second group of steam exit holes 252.

Exactly as in the preceding two embodiments, the de-wrinkling head 201 thus embodied makes it possible to obtain a steam flow that can either be distributed over the entirety of the first and second groups of steam exit holes 251, 252 when the switch 207 is in the resting position, or concentrated essentially on just the holes of the first group of steam exit holes 251, i.e. the ones disposed near the front tip 250 of the surface 205, when the user moves the switch 207 into the steam concentration position.

Such a concentration of the steam flow on a limited number of steam exit holes near the front tip of the flat surface has the advantage of making it possible to obtain a powerful and precise steam flow suitable for more effectively targeting a specific zone to de-wrinkle.

By means of an easily and cost-effectively implemented solution, such a design thus makes it possible to improve the performances of a vertical de-wrinkling appliance that utilizes a steam flow.

Indeed, the appliance thus embodied enables rapid and effective treatment of clothes made of fabrics highly permeable to steam when the switch is in the first position, owing to the distribution of steam via a large number of steam exit holes covering a large treatment surface.

Conversely, when the user wishes to de-wrinkle a garment made of a fabric that is relatively impermeable to steam and that requires a more rapid steam flow, or when said user wishes to treat a specific zone of the garment, all that is necessary is to move the switch into the second position in order to obtain more powerful steam jets via a limited number of steam exit holes.

An appliance with improved versatility and effectiveness in terms of treating garments is thus obtained.

Obviously the invention is not limited in any way to the embodiment described and illustrated here, which was only given as an example. Modifications are still possible, particularly from the standpoint of the constitution of the diverse elements or by substituting equivalent techniques, without exceeding the scope of protection of the invention in any way.

In a variant of embodiment not illustrated here, the steam flow toward the second group of steam exit holes could thus be blocked by means of a cover that is moved manually on the outer surface of the sole in such a way as to cover and block off the holes of the second group of steam exit holes.

In a variant of embodiment not illustrated here, the flat surface receiving the steam exit holes could thus make an angle of ca. 60° with the longitudinal direction of the handle.

In another variant of embodiment not illustrated here, the surface receiving the steam exit holes could thus have a curved shape.

In a variant of embodiment not illustrated here, the movable member could thus be movable in rotation for switching from the retracted position to the restriction position.

In a variant of embodiment not illustrated here, the control switch of the cover or of the partitions could thus consist of an adjustment wheel that turns about the handle.

The invention claimed is:

1. A steam de-wrinkling appliance comprising a de-wrinkling head, a base for producing a steam flow, and a line for delivering the steam flow from the base to the de-wrinkling head, the de-wrinkling head comprising a rear portion forming a handle and a flared front portion comprising a surface having one or a plurality of steam exit holes for distributing the steam flow originating from the base, the de-wrinkling head comprising a device for reducing an area of the flow toward the steam exit hole or holes, said device comprising a movable member capable of assuming a retracted position, in which the area of the flow toward the steam exit hole or holes is maximal, and a restriction position, in which the movable member reduces the area of the flow toward the steam exit hole or holes, wherein the flared front portion encloses a single steam plenum chamber that supplies steam to the steam exit hole or holes, wherein the surface has at least a first group of steam exit holes and a second group of steam exit holes and the movable member is configured to assume a retracted position, in which the plenum chamber communicates freely with the entirety of the first group of steam exit holes and second group of steam exit holes, and a restriction position, in which the movable member covers, at least partially, the second group of steam exit holes or isolates the steam plenum chamber for reducing the distribution of steam through the second group of steam exit holes, and wherein the movable member covers the holes of the second group of steam exit holes when it is in the restriction position.

2. The steam de-wrinkling appliance according to claim 1, wherein the movable member can be actuated from the outside of the de-wrinkling head by means of a control element, the actuation of the control element making it possible to move the movable member from the retracted position to the restriction position.

3. The steam de-wrinkling appliance according to claim 1, wherein the movable member moves in translation in order to shift from the retracted position into the restriction position.

4. The steam de-wrinkling appliance according to claim 3, wherein the movable member moves in translation in a direction that is essentially perpendicular to the axis of the steam exit holes.

5. The steam de-wrinkling appliance according to claim 4, wherein the control element is connected to the movable member by a lever that is movable in rotation.

6. The steam de-wrinkling appliance according to claim 3, wherein the movable member moves in translation in a direction that is essentially parallel to the axis of the steam exit holes.

7. The steam de-wrinkling appliance according to claim 6, wherein the control element is connected to the movable member by a part that is movable in translation.

8. The steam de-wrinkling appliance according to claim 1, wherein the device for blocking or reducing the flow comprises a spring that tends to return the movable member to the retracted position.

9. The steam de-wrinkling appliance according to claim 1, wherein the movable member is disposed in the steam plenum chamber.

10. The steam de-wrinkling appliance according to claim 9, wherein the movable member comprises at least one partition, which isolates the plenum chamber when it assumes the restriction position.

11. The steam de-wrinkling appliance according to claim 1, wherein the movable member comprises pins that engage in the holes of the second group of steam exit holes when said member assumes the restriction position.

12. The steam de-wrinkling appliance according to claim 1, wherein the line has one end connected to the base that communicates freely with a boiling chamber and one end connected to the de-wrinkling head that communicates freely with the plenum chamber.

13. The steam de-wrinkling appliance according to claim 1, wherein the surface receiving the steam exit holes is flat and has a generally triangular contour.

14. The steam de-wrinkling appliance according to claim 1, wherein the steam exit holes are distributed in a V on the surface of the de-wrinkling head and the holes of the first group of steam exit holes are disposed at the pointed end of the V.

* * * * *